United States Patent [19]

Shirakawa

[11] 4,113,168

[45] Sep. 12, 1978

[54] BOTTOM STRUCTURE OF CARDBOARD TYPE LIQUID PACKING CONTAINER

[75] Inventor: Kiyoshi Shirakawa, Tokorozawa, Japan

[73] Assignee: Sanyo-Kokusaku Pulp Co., Ltd., Tokyo, Japan

[21] Appl. No.: 803,932

[22] Filed: Jun. 6, 1977

Related U.S. Application Data

[63] Continuation of Ser. No. 707,539, Jul. 22, 1976.

[51] Int. Cl.[2] ..... B65D 5/08

[52] U.S. Cl. ..... 229/37 R

[58] Field of Search ..... 229/37 R, 39 R

[56] References Cited

U.S. PATENT DOCUMENTS

| | | | |
|---|---|---|---|
| 460,817 | 10/1891 | Clark | 229/37 R |
| 681,323 | 8/1901 | Houghland | 229/37 R |
| 1,924,529 | 8/1933 | Wellman | 229/37 R |
| 2,563,619 | 8/1951 | Ringler | 229/37 R |
| 3,330,466 | 7/1967 | Eckles | 229/37 R |
| 3,334,802 | 8/1967 | Gooding | 229/37 R |
| 3,362,614 | 1/1968 | Farquhar | 229/37 R |
| 3,412,922 | 11/1968 | Miller et al. | 229/37 R |
| 3,581,977 | 6/1971 | Kirksey | 229/37 R |

*Primary Examiner*—Davis T. Moorhead

*Attorney, Agent, or Firm*—Oblon, Fisher, Spivak, McClelland & Maier

[57] ABSTRACT

A bottom structure for a cardboard liquid packing container wherein the corners of the bottom structure are trebly laminated without exterior leakage paths, the central exterior portions of one pair of opposing bottom sheets are quadruply laminated, and the end portions of the other pair of opposing bottom sheets are doubly laminated at the central portion of the bottom structure, the various laminated portions being heat sealed to economically produce a highly stable and leak-proof upright container.

1 Claim, 7 Drawing Figures

BOTTOM STRUCTURE OF CARDBOARD TYPE LIQUID PACKING CONTAINER

This is a continuation, of application Ser. No. 707,539, filed July 22, 1976.

BACKGROUND OF THE INVENTION

1. Field of the Invention

The present invention relates to a cardboard type liquid packing container and, more particularly, to a bottom structure of the above-mentioned type liquid packing container in which square or rectangular recessed portions are formed at the inner central portion of the bottom thereof and the ends of the cardboard are uniformly bonded to each other, so that liquid leakage is prevented. In addition, since the corner portions of the bottom of the container are trebly folded, the container is so tough that leakage from the corners is prevented. Further, the container enables economical use of cardboard.

2. Description of the Prior Art

Recently, among containers for various materials, a cardboard type container fabricated by folding a relatively thick cardboard has been widely used to pack liquids. Such a container has been used that its value as a commodity is enhanced by printing various patterns etc. on its surface because it is relatively tough; that it is easily transportable, storable or the like because it can be formed into an accurately triangular shape; that it is easily disposable without generating a pollutant after use; that its humidity resisting property is improved if a thermoplastic synthetic resin is laminated on the surface thereof; and that its sealing property is excellent without using any special adhesives.

As a result, with respect to the cardboard type liquid packing container having such various attributes, a thicker cardboard has been increasingly used during recent years due to an increase in amount of the liquid contained therein. For this reason, it is necessary that the number of cardboard laminations in the bottom surface of the container be reduced to enhance the upright stability thereof; that any gaps be eliminated from the cardboard laminated and bonded together in constructing the bottom surface, thereby improving the sealing property; that, especially in view of using this container so as to accommodate liquids, an unreasonable force not be applied to the corner portions thereof; that mass production thereof be possible; and that the amount of cardboard used for each container be reduced.

As one example of the milk containers widely utilized during recent years, Japanese Utility Model Publication No. 46-4661 discloses a bottom structure of the liquid packing container as shown in the expansion plan view of FIG. 1. The most characteristic feature of this bottom structure lies in that the portions of the free edges of the cardboard which are in contact with the liquid charged in closing the bottom portion is minimized, and the panels 10, 11 to be folded inwardly of the container have an isosceles trangular shape wherein a vertical angle is less than 90°, rather than a right-angled isosceles triangular shape, so that the respective free edges X, X' and Y, Y' of the triangular panels 10*a* and 10*b*, and 11*a* and 11*b* to be folded firmly engage each other.

Applicant has conducted various investigations with respect to conventional cardboard type liquid packing containers and found that, in such a liquid packing container as disclosed in Japanese Utility Model Publication No. 46-4661, since the panels 10, 11 to be folded have a triangular shape, namely, their apex portions converged on a point, when the triangular panels 10*a*, 10*b*, 11*a*, 11*b* are folded along the folding lines at the both sides of the panels 10, 11, it is difficult to fold the triangular panels 10*a*, 10*b* and 11*a*, 11*b* in the vicinity of the apex portions of the triangular panels 10, 11; and when a flat bottom is formed by forming the panels 10, 11 into an acute-angled isosceles triangular shape and by folding the triangular panels 10*a*, 10*b*, 11*a*, 11*b*, the respective free edges X, X' and Y, Y' of the folding panels 10*a*, 10*b*, 11*a*, 11*b* are engaged with each other such that a strong force is applied to the central portion of the container to produce gaps in the side of the peripheral portion of the container, whereby the liquid packed therein is apt to leak.

SUMMARY OF THE INVENTION

Accordingly one object of this invention is to eliminate any deficiency of such a cardboard type liquid packing container as disclosed in Japanese Utility Model Publication No. 46-4661.

This and other objects are achieved by forming a bottom structure of a cardboard type liquid packing container in which a bottom sheet to be folded mostly inwardly of the container is formed into a trapezoidal shape produced by cutting off the apex portion from a right-angled isosceles triangle or that shape to which, in turn, rectangular insertion flap portions are bonded. The bottom sheet to be folded mostly inwardly of the container and the triangular portions to be folded outwardly of the bottom sheet are readily folded, and the free edges of the triangular portions to be folded outwardly of the bottom sheets and the free edges of the insertion flaps uniformly and integrally engage with each other to provide a leakage free, readily formed square botton container.

In particular, the present invention provides a bottom structure for a cardboard type liquid packing container constructed from a laminated cardboard of synthetic resin, the container having four side sheets bonded through side folding lines. The bottom structure is characterized by four bottom sheets bonded to each other through extensions of the side folding lines, and respectively bonded to the side sheets through bottom folding lines separating the side and the bottom sheets. The bottom sheets including a first pair of opposed rectangular bottom sheets having end portions superimposed upon each other and heat sealed to form a bottom surface, and a second pair of opposed bottom sheets, each having oblique folding lines extending at an angle of 45° from apexes formed by the intersection of the extended side folding lines and the bottom folding lines. The oblique folding lines define a pair of triangular corner sealing surfaces, a trapezoidal exterior sealing surface between the triangular corner sealing surfaces, and a rectangular sealing flap adjacent the corner and exterior sealing surfaces. The triangular corner sealing surfaces are folded 180° along the oblique folding lines such that said corner surfaces overlap and contact the end portions of the trapezoidal exterior sealing surface. The sealing flap overlaps and contacts the center portion of the trapezoidal exterior sealing surface between the overlap of the corner sealing surfaces on the trapezoidal exterior sealing surface. The triangular corner sealing surfaces and the sealing flap thus overlap the entire length of the exterior sealing surface and are heat sealed thereto. The first pair of bottom sheets are also superimposed over the corner sealing surfaces, the sealing flap and the trapezoidal exterior sealing surface and heat sealed thereto.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
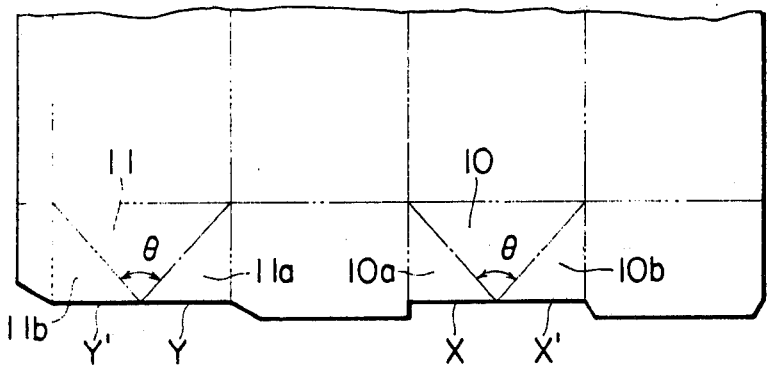
FIG. 1 is an expansion plan view illustrating the folding blank of a bottom of the conventional liquid packing container.
Figure 2:
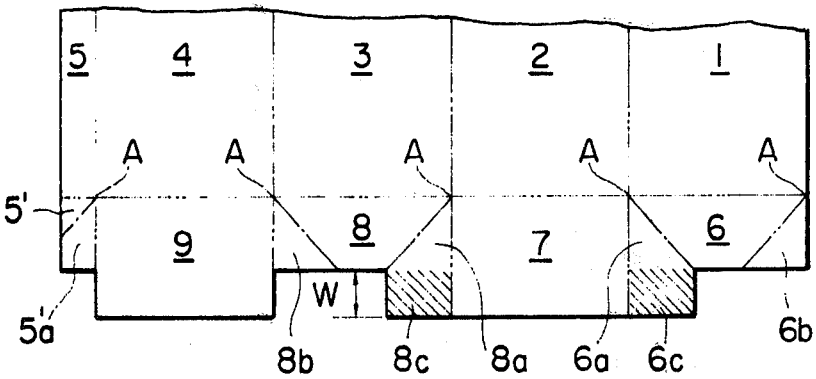
FIG. 2 is an expansion plan view illustrating the folding blank of one embodiment of bottom structures of a liquid container according to the present invention.
Figure 5:
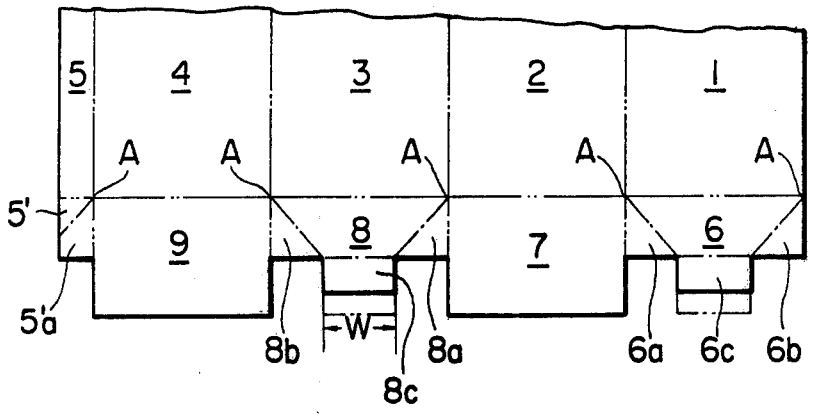
FIG. 5 is an expansion plan view illustrating the folding blank of another embodiment of a bottom structure of a liquid packing container according to the present invention.

Referring now to the drawings, wherein like reference numerals designate identical or corresponding parts throughout the several views, and more particularly to FIGS. 2 and 5 thereof, a broken line is a folding line along which a cardboard is inwardly folded, and a dotted line is a folding line along which a cardboard is outwardly folded. In the drawings, numerals 1, 2, 3 and 4 are four side sheets connected through the respective folding lines. In order to form side walls of the container by these four side sheets 1, 2, 3 and 4, a bonding flap 5 is bonded through a folding line to the side sheet 4 which is one end side sheet thereof. The numerals 6, 8 and 7, 9 relate to bottom sheets respectively bonded to a set of the opposited side sheets 1, 3 and 2, 4 through the folding lines. These bottom sheets 6, 7, 8 and 9 are bonded the respective extending folding lines between the side sheets 1 and 2, 2 and 3, 3 and 4, and 4 and 1. 5' is an extending bonding flap for the extending bottom side of the flap 5, by which the bottom sheets 9 and 6 are together bonded to each other. Of these four bottom sheets 6, 7, 8 and 9, a set of the opposed bottom sheets 7 and 9 forms a bottom surface, the end portions of which are superposed upon each other and sealed by heating. On the other hand, another set of the opposed bottom sheets 6 and 8 has a width sufficient to be sealed by heating onto the inner sides of the both sides of the bottom sheet 7 and 9 which form a bottom surface, and has at its both sides portions *6a, 6b* and *8a, 8b* which are folded into a triangular shape along the folding lines extending at an angle of 45° obliquely from apexes A of the corner portions. Further, the inserting flaps *6c,* and *8c* are bonded to the end portions of the portions *6a* and *8a* to be folded into a triangular shape, or to the end portions of the bottom sheets 6, 8 between the portions *6a* and *6b,* and *8a* and *8b* which are folded into a triangular shape. These inserting flaps *6c* and *8c* are respectively inserted in between the two sets of bottom sheets 6, 8 and 7, 9 along the exterior sides of the folded sheets 6, 8 at the inner central portion of the bottom surface between the folded triangular portions *6a* and *6b,* and *8a* and *8b* of a cardboard bore to be fabricated, whereby the exterior sides and corners of the bottom surface adjacent the side sheets 1, 3 are sealed.

As shown in FIG. 5, when the inserting flaps *6c* and *8c* are respectively inserted in between the portions *6a* and *6b,* and *8a* and *8b* which are folded into a triangular shape, the width W of the inserting flaps *6c* and *8c* should be equal to or slightly larger than the distance between the tips of the oblique folding lines opposite the apexes A. It is further noted that, when the inserting flaps *6c* and *8c* are folded at an angle of 180° along the folding lines of the bottom sheets 6, 8 the free edges of the both sides of the inserting flaps *6c* and *8c* engage the portions *6a, 6b* and *8a, 8b* which are folded into a triangular shape. A length of the inserting flaps may be either short, as shown by a solid line, or long as shown by a phantom line. As shown in FIG. 2, where the inserting flaps *6c* and *8c* with hatched portions append from the respective ends of the portions *6a* and *8a* which are folded into a triangular shape, the width W of the inserting flaps *6c* and *8c* should likewise be equal to or slightly larger the distance between the tips of the oblique folding lines opposite the apexes A.

Furthermore, when the portions *6a* and *8a* to be folded into a triangular shape are folded along the oblique folding lines of 45° between the bottom sheets 6 and 8, the free edges of the sides of the inserting flaps *6c* and *8c* must respectively engage the free edges of the portions *6b* and *8b* to be folded into a triangular shape, and must make a right angle with respect to the tip portions of the bottom sheets 6, 8. In addition, the folding lines obliquely extending from apexes A of the corner portions must be accurately folded at an angle of 45° in order to ensure that the free edges at the sides of the inserting flaps *6c* and *8c* generally engage under the action of uniform force the free edges at the sides of the bottom portions of the portions *6a, 6b* and *8a, 8b* or *6b* and *8b* which are folded into a triangular shape. Since such a folding line is provided at the extending bonding flap 5' connected through the folding line to the extending portion of the bonding flap 5, the portion *5a'* to be folded into a triangular shape is correspondingly folded on the extending bonding flap 5'.

In order to form a bottom of the liquid packing container by using a laminated cardboard of the thermoplastic synthetic resin, firstly, the respective side sheets 1, 2, 3 and 4 are inwardly folded at a right angle along the side folding lines between each of the sheets and the folding line between the side sheet 4 and the bonding flap 5. The surface of the bonding flap 5 and the rear surface of the side end of the side sheet 1 then overlap and are heat sealed.

Thus, when the respective side sheets 1, 2, 3, 4 and the bonding flap 5 are inwardly folded at a right angle, the bottom sheets 6, 7, 8, 9 and the extending bonding flap 5' are correspondingly folded inwardly at a right angle along the bottom folding lines between the bottom sheets 6 and 7, 7 and 8, 8 and 9, and the bottom sheet 9 and the extending bonding flap 5'. Then, the surface of the bonding flap 5 and the rear surface of the side end of the side sheet 1 are sealed by heating while, at the same time, the surface of the extending bonding flap 5' and the rear surface of the side end of the bottom sheet 6 are likewise sealed.

Figure 3:
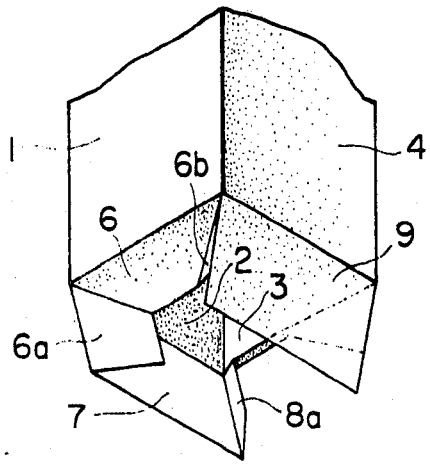
FIG. 3 is a perspective view illustrating the folding of the cardboard blank shown in the expansion plan view of FIG. 2.
Figure 4:
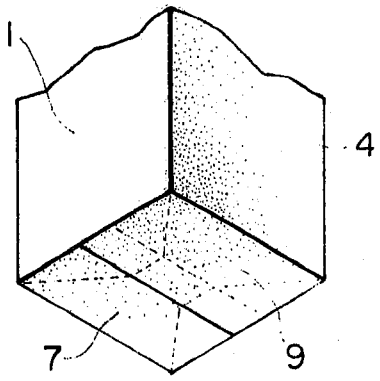
FIG. 4 is a perspective view illustrating the folded and sealed cardboard blank shown in the expansion plan view of FIG. 2, having a square bottom.
Figure 6:
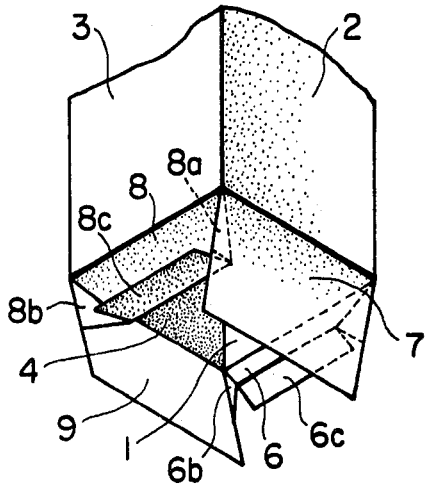
FIG. 6 is a perspective view illustrating the folding of the cardboard blank shown in the plan view of FIG. 5; and, FIG. 7 is a perspective view illustrating the folded and sealed cardboard blank shown in the expansion plan view of FIG. 5, having a square bottom.
Figure 7:
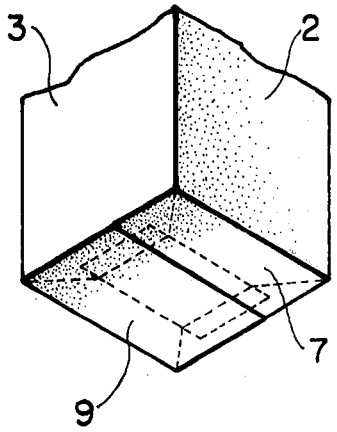

A quadrilateral cylinder is formed by such an operation. Next, as shown in FIGS. 3 and 6, the respective bottom sheets 6, 7, 8 and 9 are inwardly folded. In FIG. 6, the inserting flaps 6*c* and 8*c* which are provided on the end portions of the bottom sheets 6 and 8, are folded at an angle of 180° along the horizontal folding lines in the bottom sheets 6 and 8. Folding the respective bottom sheets 6, 7, 8 and 9 is effected by means of the folding lines between each of these sheets and the side sheets 1, 2, 3 and 4.

In FIG. 6, however, the respective triangular portions 6*a*, 6*b* and 8*a*, 8*b* are outwardly folded along the corresponding oblique folding lines. After the folding of portions 6*a*, 6*b* and 8*a*, 8*b* into a triangular shape along the folding lines obliquely extending from apexes A of the corner portions at the both sides of the respective bottom sheets 6 and 8, and the folding of the portion 5*a* of the extending bonding flap 5' into a triangular shape, at an angle of 180° to the respective folding lines, and after the respective bottom sheets 6, 7, 8, 9 and the extending bonding flap 5' are correspondingly folded at an angle of 90° along the bottom folding lines between these sheets and the respective side sheets 1, 2, 3, 4 and the bonding flap 5, the surfaces of the bottom sheets 6, 8 and the surfaces of the portions folded into a triangular shape 6*a*, 6*b* and 8*a*, 8*b* are sealed by heating and the surfaces of the bottom sheets 6, 8 and the surfaces of the inserting flaps 6*c*, 8*c* are likewise sealed by heating.

Finally, the superposed portions of the rear surfaces of the both sides of the bottom sheets 7, 9 and the rear surfaces of the inserting flaps 6*c*, 8*c* are sealed by heating while the superposed portion of the bottom sheets 6 and 8 are heat-sealed whereby the bottom structure of the cardboard liquid packing container is fabricated according to the present invention.

It is noted that it is within the scope of the present invention to heat-seal the superposed portions of the rear surfaces of the portion 6*a*, 6*b* and 8*a*, 8*b* of the corner portions, folded into a triangular shape, and the rear surfaces of the bottom sheets 7, 9.

In a bottom structure of the liquid packing container constructed according to the present invention, the portions to be folded are readily folded, since the bottom sheets 6 and 8 to be folded mostly inwardly of the container have a trapezoidal shape formed by cutting off the apex portion from a right-angled isosceles triangle, and the folding lines, along which the portions 6*a*, 6*b* and 8*a*, 8*b* are folded into a triangular shape at the both sides of the free edges of the bottom sheets 6, 8, are spaced so that these lines do not converge on a point of the apex portions of the bottom sheets 6 and 8. In addition, since the free edges of the portions 6*a*, 6*b*, 8*a*, 8*b* which are satisfactorily folded along the folding lines and the inserting flaps 6*c* and 8*c*, or those of the portions 6*b* and 8*b* which are folded into a triangular shape and the inserting flaps 6*c* and 8*c* are uniformly engaged with each other as a whole, liquid leakage is positively prevented. Further, in a bottom structure of the container according to the present invention, since the corner portions are trebly (quadruply only at the portions including the extending bonding flaps) folded without any leakage paths to the outside, such that leakage of the charged liquid from the corners is precluded. Since cardboards of two plies, i.e., one ply composed of the portions 6*a*, 6*b*, 8*a*, 8*b* which are folded into a triangular shape and bonded to the bottom sheets 6 and 8 and the inserting flaps 6*c* and 8*c*, and the other ply composed the bottom sheets 6 and 8, sealingly engage the both surfaces of the bottom sheets 7 and 9, no internal gaps are formed in contact with the packed liquid when viewed from the sides of the bottom sheets. In addition, since the free edges of the inserting flaps 6*c*, 8*c* and those of one or more of the portions 6*a*, 6*b*, 8*a*, 8*b* which are folded into a triangular shape uniformly engage each other, no leakage paths are provided, thus resulting in complete prevention of leakage. Moreover, in a bottom structure of the container according to the present invention, if a set of the side sheets 1 and 3 has a narrower width and another set of the side sheets 2 and has a broader width, each bottom sheet is economically and easily fabricated from thin cardboard.

Such an economical fabrication of the bottom sheets has not previously been utilized in fabricating a commercially available milk container and, hence, Applicant's invention compares favorably to the conventional milk container wherein the bottom is poorly sealed unless its shape is square.

As thus stated, such a structure for a cardboard type liquid packing container has various merits, and enables the economical use of a relatively small piece of cardboard without any checks, and is simply thus fabricated.

In particular, when liquid is charged therein, an improved sealing property is exhibited, which is produced by uniformly engaging the free edges of the inserting flaps provided with those of the portions to be folded into a triangular shape. Therefore, the structure according to the present invention is very practical.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. In a bottom structure of a cardboard liquid packing container constructed from a laminated cardboard of synthetic resin, said container having four side sheets bonded through side folding lines, the improvement comprising:

four bottom sheets bonded to each other through extensions of said side folding lines, and respectively bonded to said side sheets through bottom folding lines separating said side and said bottom sheets; said bottom sheets including a first pair of opposed rectangular bottom sheets having end portions superimposed upon each other and heat sealed to form a bottom surface, and a second pair of opposed bottom sheets, each having oblique folding lines extending at an angle of 45° from apexes formed by the intersection of said extended side folding lines and said bottom folding lines, said oblique folding line defining a pair of triangular corner sealing surfaces, a trapezoidal exterior sealing surface between said triangular corner sealing surfaces, and a rectangular sealing flap adjacent said corner and said exterior sealing surfaces, said triangular corner sealing surfaces folded 180° along said oblique folding lines such that said corner surfaces overlap and contact the end portions of said trapezoidal exterior sealing surface and said sealing flap overlaps and contacts the center portion of said trapezoidal exterior sealing surface between the overlap of said corner sealing surfaces on said exterior sealing surface, said triangular corner sealing surfaces and said sealing flap overlapping the entire length of said exterior sealing surface and heat sealed thereto, and said first pair of bottom sheets also superimposed over said corner sealing surfaces, said sealing flap and said exterior sealing surface and heat sealed thereto.

* * * * *